US008282440B2

(12) United States Patent
Jenkins et al.

(10) Patent No.: US 8,282,440 B2
(45) Date of Patent: Oct. 9, 2012

(54) LOW POWER ELECTRONIC SPEED CONTROL FOR A MODEL VEHICLE

(75) Inventors: Michael S. Jenkins, Fairview, TX (US); Kent Poteet, Lucas, TX (US); Brent W. Byers, Plano, TX (US)

(73) Assignee: Traxxas LP, Plano, TX (US)

( * ) Notice: Subject to any disclaimer, the term of this patent is extended or adjusted under 35 U.S.C. 154(b) by 1185 days.

(21) Appl. No.: 11/455,984

(22) Filed: Jun. 20, 2006

(65) Prior Publication Data

US 2007/0293125 A1 Dec. 20, 2007

(51) Int. Cl.
*A63H 30/00* (2006.01)
*A63H 29/00* (2006.01)

(52) U.S. Cl. ..... 446/454; 446/457; 463/62

(58) Field of Classification Search ..... 463/1, 6, 463/27, 36–40, 62; 446/454, 456–457, 462
See application file for complete search history.

(56) References Cited

U.S. PATENT DOCUMENTS

| | | | | |
|---|---|---|---|---|
| 6,287,167 | B1 * | 9/2001 | Kondo | 446/454 |
| 2002/0187726 | A1 * | 12/2002 | Yamaguchi | 446/454 |
| 2003/0114075 | A1 * | 6/2003 | Moll et al. | 446/456 |

FOREIGN PATENT DOCUMENTS

JP 2000-51540 A 2/2000

OTHER PUBLICATIONS

"E-Maxx Owners Manual—Model 3906", 2002, Traxxas.*
"Jumpers", 2004, PCGuide, available at <http://www.pcguide.com/intro/fun/jump.htm>.*
"E-Maxx Rooster Combo Operating Instructions", 2001, Novak Electronics.*
Novak, "Super Sport Instruction Manual" Novak Electronics, Inc.; U.S.A. Feb. 2003.
Novak, "Profile Selection & Proper Gearing" Novak Electronics, Inc.; U.S.A. Feb. 2005.
Traxxas; "XL-1 Forward/Reverse Electronic Speed Control"; Traxxas LP, Plano, Texas.
Traxxas; "EVX ELectronic Speed Control Installation/Operation Instructions"; Traxxas Lp, Plano, Texas, 2004.
Traxxas; "XL-10 Electronic Speed Control Instructions"; Traxxas LP, Plano, Texas.
Product Design; "Turbo Zeta Instruction Booklet"; Product Design Inc., Redmond, Washington.

(Continued)

*Primary Examiner* — David L Lewis
*Assistant Examiner* — Werner Garner
(74) *Attorney, Agent, or Firm* — Carr LLP

(57) ABSTRACT

A system and method are provided for low power electronic speed control for a model vehicle. A remote controlled model vehicle system may comprise a motor, a transmitter, a receiver, and an electronic speed control device. The electronic speed control device comprises a user interface and is at least configured to control a magnitude of average power applied to the motor in response to a user input. The electronic speed control device can operate under at least two profiles, wherein a desired profile is selected by the user. In one embodiment, under a first profile the electronic speed control device applies 100% magnitude of average power to the motor in response to maximum forward throttle, and under a second profile the electronic speed control device applies a percentage magnitude of average power lower than 100% and greater than 0% to the motor in response to maximum forward throttle.

9 Claims, 6 Drawing Sheets

OTHER PUBLICATIONS

Castle Creations; "Mamba Max User Guide"; Castle Creations, Inc., Olathe, Kansas, 2006.
Castle Creations; "Mamba-25" instruction sheet; Castle Creations, Inc., Olathe, Kansas, 2004.
Castle Creations; "Phoenix-60" instruction sheet; Castle Creations, Inc., Olathe, Kansas, 2004.
Castle Creations; "Castle Link USB Programming Kit" Web page; Castle Creations, Inc., Olathe, Kansas, 2006.
Wikipedia; "Electronic speed Control" article; Wikimedia Foundation, Inc. http://en.wikipedia.org/wiki/Electronic_speed_control, Jul. 12, 2006.
Wikipedia; "Castle Creations" article; Wikimedia Foundation, Inc. http://en.wikipedia.org/wiki/Castle_Creations, Jul. 12, 2006.
Wikipedia; "Wireless USB" article; Wikimedia Foundation, Inc. http://en.wikipedia.org/wiki/ Wireless_USB, Jul. 12, 2006.
Teamnovak.com; "Technical Info—Speed Control Terminology", "What is Drive PWM Frequency?", "What is Brake PWN Frequency?", http://www.teamnovak.com/tech_info/esc_termin/index.html; 2012.
Teamnovak.com; "Technical Info—Speed Control Application & Installation", "What effect does changing the Drive or Brake PWM frequency have?"; http://www.teamnovak.com/Tech_info/esc_applic/index.html; 2012.
Klejwa, Kevin; RCgroups.com; "ESC switching frequency . . . high or low?"; http://www.rcgroups.com/forums/showthread.php?t=29618, 2002.

* cited by examiner 100
104
106
108
102
110
TRANSMITTER
RECEIVER
MOTOR
CONTROLLER
114
DC
116
M
112

112A
MOTOR CONTROLLER
INPUT
FROM
RECEIVER
202
204
USER INTERFACE
206A
CONTROL LOGIC
208
POWER
OUTPUT
210
114
DC
116
M

LOW POWER ELECTRONIC SPEED CONTROL FOR A MODEL VEHICLE

FIELD OF THE INVENTION

This disclosure relates to systems and methods for low power electronic speed control for model vehicles, and, more particularly, to a device that allows a user to adjust the maximum power supplied to a motor of a model vehicle.

DESCRIPTION OF THE RELATED ART

In traditional model vehicles, a battery or similar power source is connected to a motor of the model vehicle. The motor receives its power input from the battery, wherein the power input is normally managed by a means of throttle control. Power applied to a motor can be adjusted in different manners including adjustable currents and voltages. Throughout this disclosure, the power applied to the motor will be described as the magnitude of average power, so as not to limit the power outputs to specific current or voltage levels. Conventional batteries are not adjustable with respect to voltage, and therefore the power output from these batteries is controlled to apply a specific magnitude of average power to the motor in response to the user's variable control input, specifically the magnitude of average power is controlled and not the specific voltage. Accordingly, if the user is applying maximum throttle to the model vehicle then the battery applies a maximum (100%) magnitude of average power to the motor. This maximum magnitude of average power enables the model vehicle to travel at a top speed in a forward direction and/or a similar top speed in a reverse direction.

The maximum magnitude of average power applied to the motor can cause significant problems for the motor. Specifically, running the motor at maximum throttle for an extended time period can cause the motor to overheat, which can permanently damage the motor. In addition, running the model vehicle at top speeds can be dangerous for an inexperienced user. With a powerful motor in a model vehicle an inexperienced user may not be able to maintain control of the vehicle, which can lead to accidents that may damage the vehicle.

A power control mechanism could provide an advantage for a model vehicle by avoiding some of the drawbacks described above. Accordingly, it would be a clear advantage over the prior art to enable a user to easily adjust the magnitude of average power that can be applied to the motor of the model vehicle.

SUMMARY OF THE INVENTION

The claimed invention provides a system and a method for low power electronic speed control for a model vehicle. A remote controlled model vehicle system may comprise a motor, a transmitter, a receiver, and an electronic speed control device. The electronic speed control device comprises a user interface and is at least configured to control a magnitude of average power applied to the motor in response to a user input. The electronic speed control device can operate under at least two profiles, wherein a desired profile is selected by the user. In one embodiment, under a first profile the electronic speed control device applies 100% magnitude of average power to the motor in response to maximum forward throttle, and under a second profile the electronic speed control device applies a percentage magnitude of average power lower than 100% and greater than 0% to the motor in response to maximum forward throttle.

In a further embodiment, under the first profile the electronic speed control device applies 100% magnitude of average power to the motor in response to maximum reverse throttle, and under the second profile the electronic speed control device applies a percentage magnitude of average power lower than 100% and greater than 0% to the motor in response to maximum reverse throttle. In some embodiments, the percentage magnitude of average power applied to the motor for the second profile is substantially equal for maximum forward throttle and maximum reverse throttle. In one embodiment, the electronic speed control device applies 0% magnitude of average power to the motor in response to reverse throttle for the first or the second profile. The user may select the desired profile through a user interface on the electronic speed control device. The user interface may comprise at least one button, at least one LED, at least one switch, and/or at least one jumper and a plurality of pins, which enable the user to select the desired profile.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

In the following discussion, numerous specific details are set forth to provide a thorough understanding of the present disclosure. However, those skilled in the art will appreciate that the claimed invention may be practiced without such specific details. In other instances, well-known elements have been illustrated in schematic or block diagram form in order not to obscure the present disclosure in unnecessary detail. Some of the descriptions in the present disclosure refer to hardware components, but as those skilled in the art will appreciate, these hardware components may be used in conjunction with hardware-implemented software and/or computer software.

Figure 1:
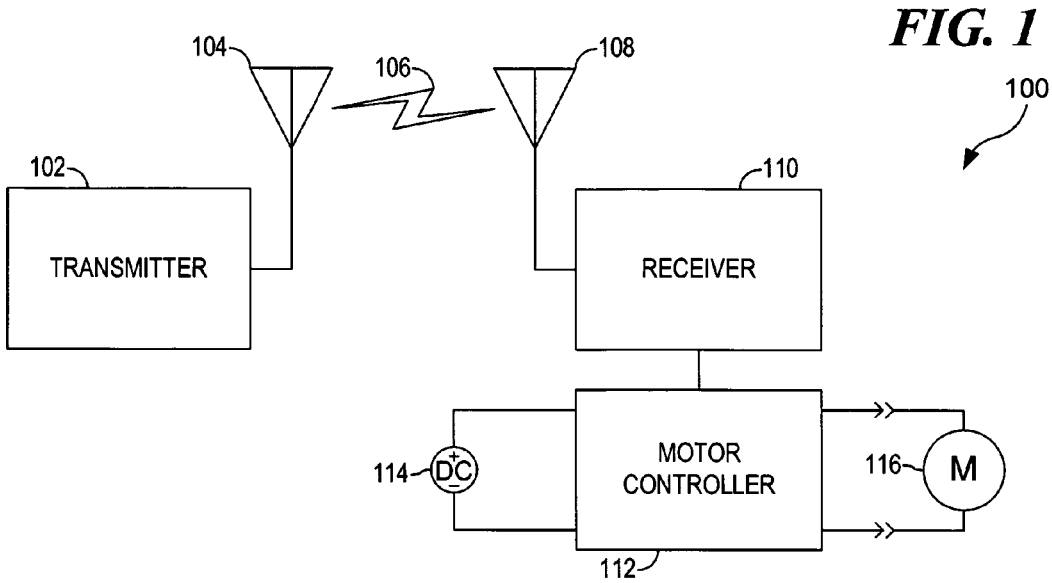
FIG. 1 is a block diagram illustrating a system for controlling the magnitude of average power applied to a motor in a remote controlled model vehicle.

FIG. 1 is a block diagram 100 illustrating a system for controlling the magnitude of average power applied to a motor 116 in a remote controlled model vehicle. A user of a model vehicle may use a transmitter 102 to provide control input to the model vehicle. Accordingly, the user manipulates the transmitter 102 to control speed, and typically direction, of the model vehicle. The transmitter 102 comprises an antenna 104 for transmitting user input to a receiver 110. The receiver 110 also comprises an antenna 108 for receiving the user input from the transmitter 102. In some embodiments, the transmitter 102 transmits a radio frequency signal 106 to the receiver 110. The receiver 110 is coupled to a motor controller 112 and may be located on the model vehicle. The motor controller 112 receives the user input from the receiver 110 and applies a magnitude of average power to the motor 116 accordingly. A battery 114 may supply the motor controller 112 with power. Overall, the battery 114 supplies the motor controller 112 with power, and the motor controller 112 can manage the magnitude of average power supplied to the motor 116 in response to the user input from the receiver 110.

In some embodiments the motor controller 112 may be an electronic speed control device. The electronic speed control device may enable a user to control electric power applied to the motor 116. For example, an inexperienced user may want to reduce the top speed of the model vehicle. By adjusting the electronic speed control device the user can reduce the amount of power supplied to the motor 116 at any throttle setting, which consequently reduces the speed of the model vehicle at any given throttle setting.

Figure 2A:
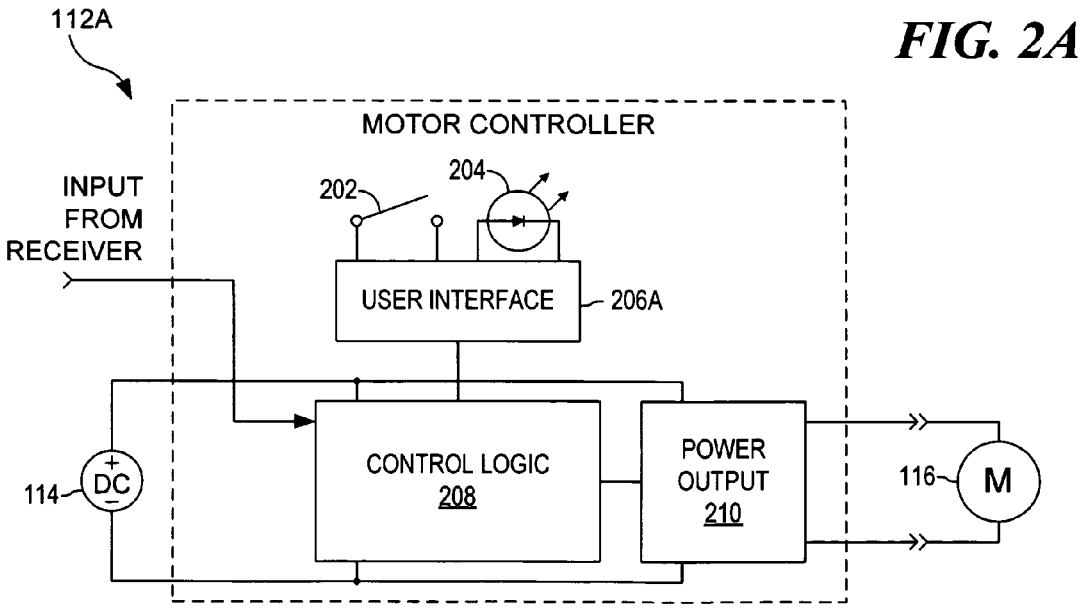
FIG. 2A is a detailed block diagram illustrating a motor controller comprising a user interface, wherein the user interface comprises a button and an LED.

FIG. 2A is a detailed block diagram illustrating a motor controller 112A comprising a user interface 206A, wherein the user interface 206A comprises a button 202 and an LED 204. As previously described, the motor controller 112A receives user input from the receiver (FIG. 1) and supplies the corresponding magnitude of average power to the motor 116. The battery 114 supplies power to the motor controller 112A. The motor controller 112A may comprise the user interface 206A, a control logic 208, and a power output 210. The user interface 206A enables the user to control the operation of the motor controller 112A. A switch or a button 202 may enable the user to enter a desired mode of operation. One or more light-emitting diodes ("LEDs") may indicate a selected mode of operation, thereby enabling the user to interact with the motor controller 112A to ensure that the user selects the desired mode of operation. Accordingly, the user may press and/or release the button 202 in response to the LED or LEDs 204 to select the desired mode of operation via the control logic 208. The control logic 208 manages the power output 210, wherein the power output 210 can supply a specific magnitude of average power to the motor 116. Therefore, the control logic 208 manages the magnitude of average power applied to the motor 116, in response to the desired mode of operation and the user control input from the receiver.

Figure 2B:
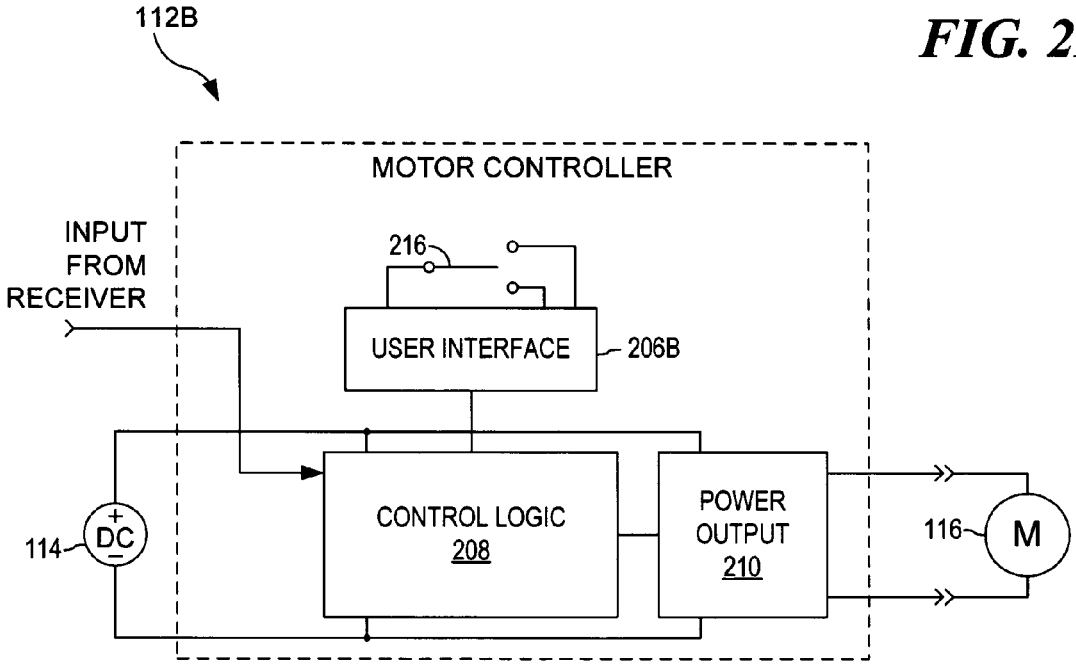
FIG. 2B is a detailed block diagram illustrating a motor controller comprising a user interface, wherein the user interface comprises a two position switch.

FIG. 2B is a detailed block diagram illustrating a motor controller 112B comprising a user interface 206B, wherein the user interface 206B comprises a two position switch 216. The motor controller 112B of FIG. 2B operates in a similar manner to the motor controller 112A of FIG. 2A. The user may select the desired mode of operation by actuating the switch 216. FIG. 2B illustrates the two position switch 216, but in alternative embodiments the switch may comprise more positions for more modes of operation.

Figure 2C:
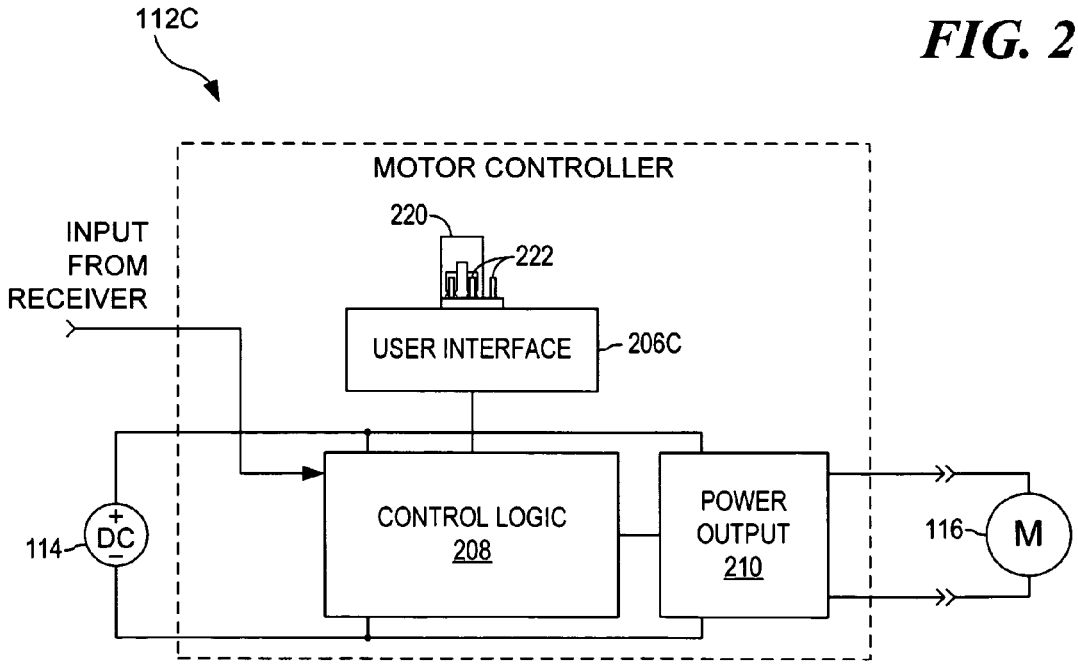
FIG. 2C is a detailed block diagram illustrating a motor controller comprising a user interface, wherein the user interface comprises an electric jumper and a plurality of pins.

FIG. 2C is a detailed block diagram illustrating a motor controller 112C comprising a user interface 206C, wherein the user interface 206C comprises an electric jumper 220 and a plurality of pins 222. The motor controller 112C of FIG. 2C operates in a similar manner to the motor controller 112A of FIG. 2A. The user may select the desired mode of operation by applying the jumper 220 to the correct set of pins 222. FIG. 2C illustrates one jumper 220 with three pins 222, but in alternative embodiments the user interface may comprise more jumpers and/or pins for more modes of operation. In another embodiment, there may be as few as two pins and only one jumper.

Figure 3:
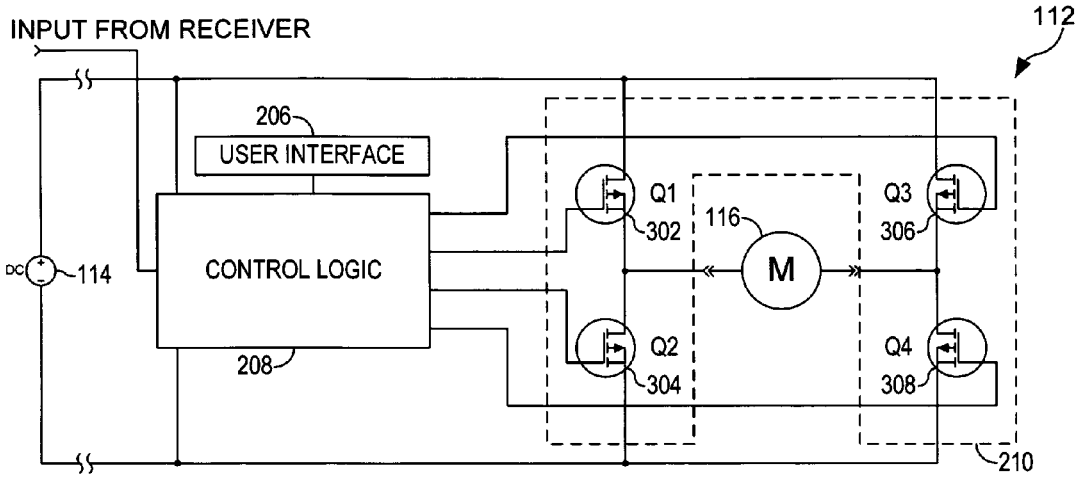
FIG. 3 is a diagram illustrating a motor controller comprising a control logic and a power output that supplies power to a motor.

FIG. 3 is a diagram illustrating a motor controller 112 comprising a control logic 208 and a power output 210 that supplies power to a motor 116. As shown in FIGS. 2A-C, the motor controller 112 may also comprise a user interface 206. A battery 114 may supply power to the motor controller 112. As previously described, the control logic 208 controls the power output 210, by which the control logic 208 controls the magnitude of average power applied to the motor 116.

FIG. 3 illustrates one embodiment of the configuration of the power output 210. The power output 210 is briefly described in this disclosure because as those skilled in the art will understand, this feature of the present disclosure can be accomplished through many alternative embodiments. The battery 114 is coupled to four transistors, Q1 302, Q2 304, Q3 306, and Q4 308, wherein the battery 114 supplies these transistors with a DC voltage. In further embodiments, there may be additional transistors in the power output 210. For example, each section of the bridge may comprise several transistors in parallel. These transistors 302, 304, 306, 308 are coupled to the control logic 208, wherein the control logic 208 controls the operation of these transistors. In some embodiments, these transistors 302, 304, 306, 308 are MOSFET transistors. The control logic 208 may drive these transistors 302, 304, 306, 308 to convert an input voltage from the battery 114 to a pulse width modulated ("PWM") signal that drives the motor 116. Accordingly, the PWM signal can provide power to the motor 116, and the control logic 208 can adjust the PWM signal by switching on and off the transistors 302, 304, 306, 308. If the control logic 208 is supplying a 100% magnitude of average power, then the appropriate transistors 302, 304, 306, 308 will be on for a given period of time for delivering forward polarity to the motor 116. If the control logic 208 is supplying a 50% magnitude of average power, then the appropriate transistors 302, 304, 306, 308 are on for the same amount of time that they are off, which indicates that the transistors 302, 304, 306, 308 are on for 50% of the duty cycle (or period). Accordingly, the variable duty cycle of the transistors determines the percentage magnitude of average power. As previously described, FIG. 3 only represents one embodiment of the present disclosure.

Figure 4:
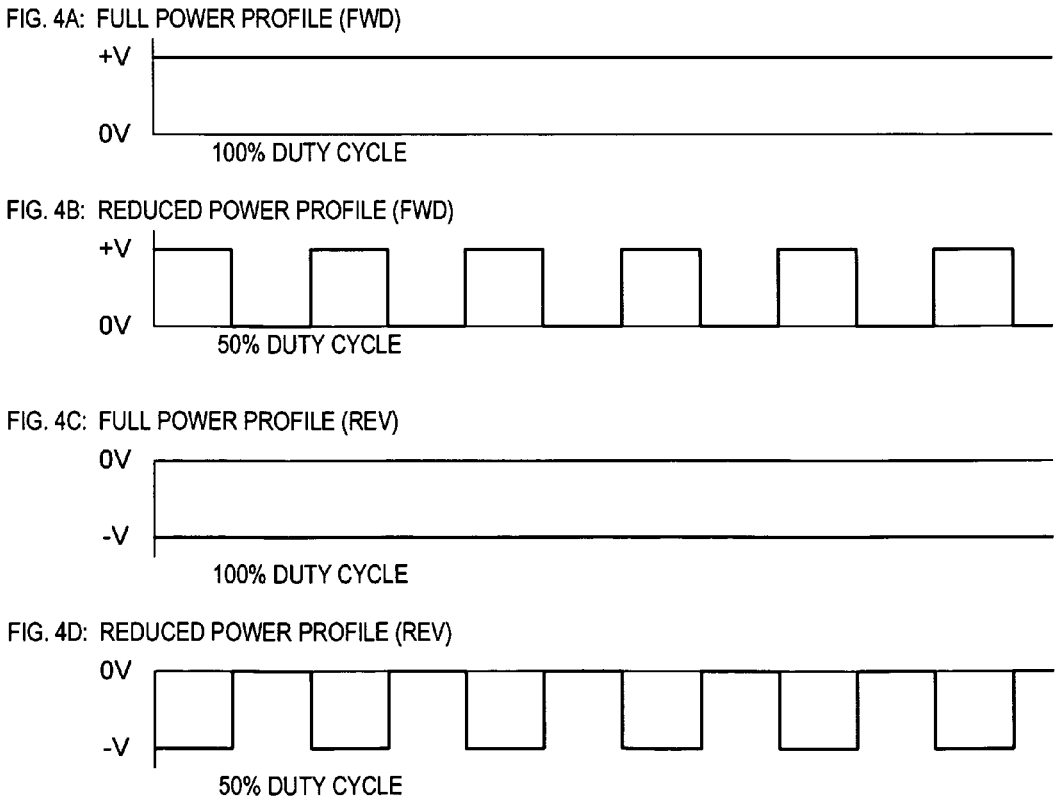
FIG. 4 illustrates four timing diagrams that depict power output to a motor for multiple profiles.

FIG. 4 illustrates four timing diagrams that depict power output as a PWM signal to a motor for multiple profiles. In FIG. 4, the power outputs shown are in response to maximum throttle user input for different profiles. FIG. 4A illustrates a 100% magnitude of average power profile for a maximum forward throttle user input. Accordingly, in FIG. 4A a 100% duty cycle PWM signal is supplied to the motor in response to maximum forward throttle. FIG. 4B illustrates a 50% magnitude of average power profile for a maximum forward throttle user input. Accordingly, in FIG. 4B a 50% duty cycle PWM signal is supplied to the motor in response to maximum forward throttle. FIG. 4C illustrates a 100% magnitude of average power profile for a maximum reverse throttle user input. Accordingly, in FIG. 4C a 100% duty cycle PWM signal is supplied to the motor in response to maximum reverse throttle. FIG. 4D illustrates a 50% magnitude of average power profile for a maximum reverse throttle user input. Accordingly, in FIG. 4D a 50% duty cycle PWM signal is supplied to the motor in response to maximum reverse throttle. In one embodiment, FIGS. 4A and 4C may represent a first profile, and FIGS. 4B and 4D may represent a second profile.

Figure 5A:
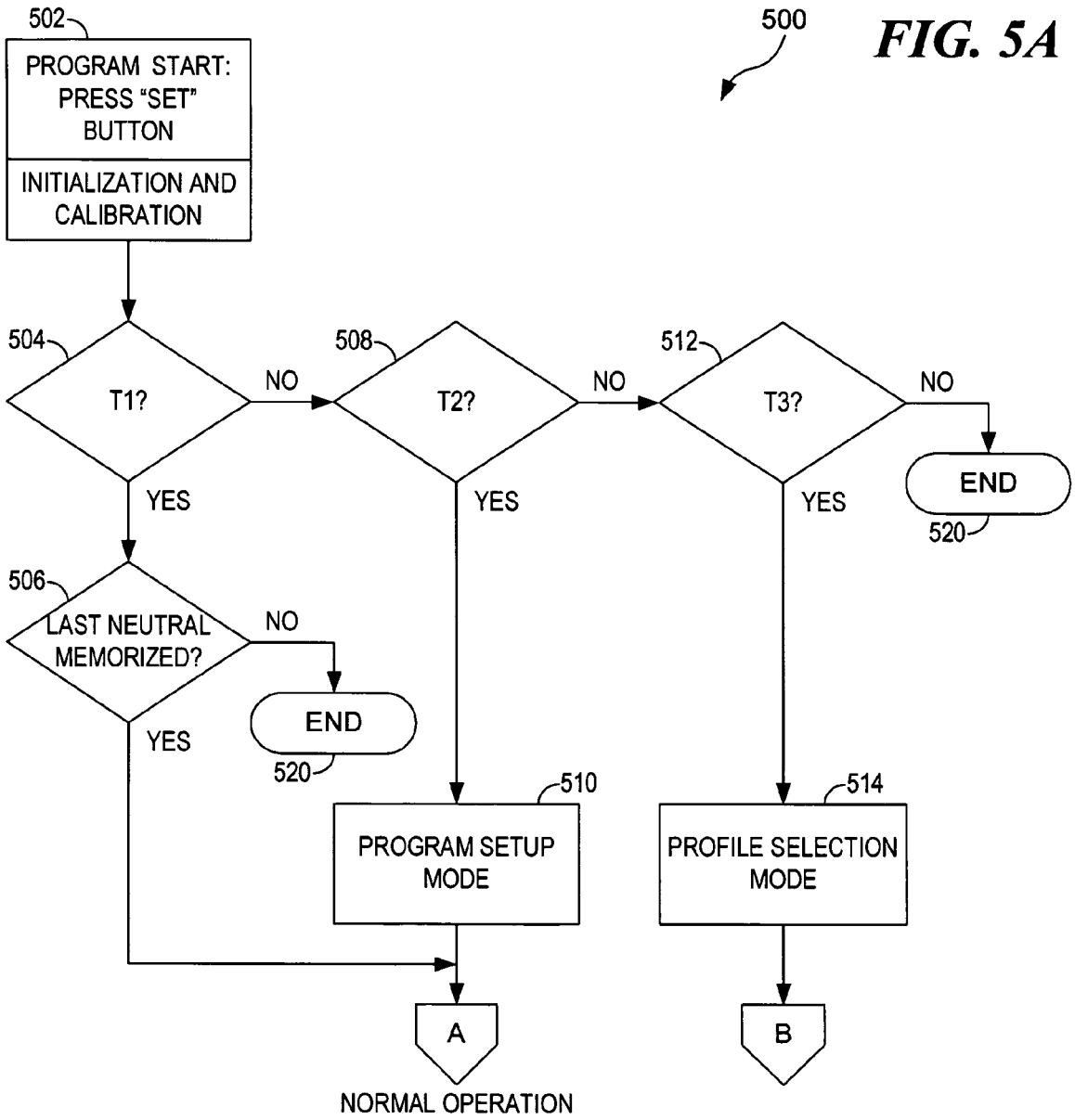
FIGS. 5A-B illustrate a logic chart for a program setup mode and a profile selection mode utilized in one embodiment of the system.
Figure 5B:
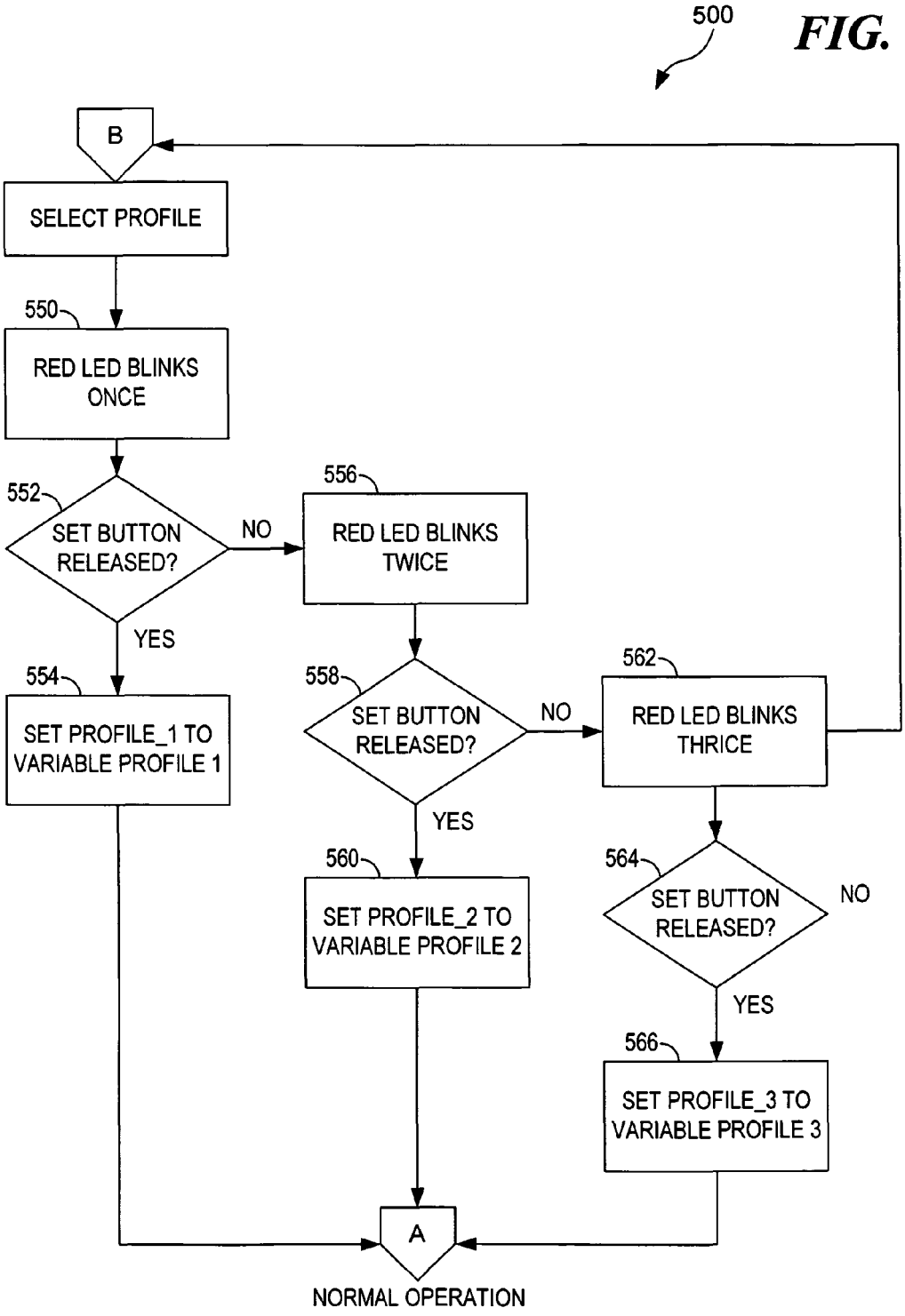

FIGS. 5A and 5B illustrate a logic chart 500 for a program setup mode and a profile selection mode utilized in one embodiment of the remote controlled model vehicle system. The program setup mode and the profile selection mode may be controlled by the user through the use of a button and an LED located on or connected to the model vehicle as shown in FIG. 2A. This button may be called the "set" button. In the following description the model vehicle comprises a system that accomplishes the features shown in the logic chart 500. This system may comprise an electronic speed control device. FIGS. 5A and 5B illustrate an example of one embodiment of the claimed invention. Accordingly, the use of this example of the claimed invention does not limit the scope of the present disclosure.

To start the program the user may turn on the transmitter with the throttle at neutral. Default values of the transmitter are for 50/50 throttle position, by which neutral is considered to be halfway between full forward throttle and full reverse throttle. The user may then connect a fully charged battery pack to the electronic speed control device. Program setup and profile setup can be started by pressing the "set" button 502. After pressing the "set" button, the system may determine how long the user held the "set" button down before releasing it. First, the system determines if the user held the "set" button down for a specific first time period, T1 504. For example, T1 504 could be greater than 1 sec. and less than 2 sec. If the user did hold down the button for this period of time, then the last memorized neutral setting from the throttle on the transmitter may be used 506. After the conclusion of this step the electronic speed control device may be used for normal operation. If there was no memorized neutral setting, then the electronic speed control device cannot be used 520.

Second, the system determines if the user held the "set" button down for a specific second time period, T2 308. If the user did hold down the button for this period of time, then the system may launch into program setup mode 510. In program setup mode 510 the user may initialize the neutral setting for the throttle. After these steps the electronic speed control device may be used for normal operation. Overall, FIG. 5A focuses on the program setup mode.

Third, the device determines if the user held the "set" button down for a specific third time period, T3 512. If the user did not hold the "set" button down for any of these time periods T1 504, T2 508, or T3 512, then the electronic speed control device cannot be used. If the user did hold the "set" button down for T3 512, then the system may launch into profile selection mode 514.

Profile selection mode is described with reference to FIG. 5B. After profile selection mode has been selected 514 the red LED blinks once 550. The user should still be holding down the "set" button in the profile selection mode. The system determines whether the user released the "set" button during a first predetermined time period during or after the red LED has blinked once 552. If the user released the "set" button during the first predetermined time period then the electronic speed control device selects profile 1 554. If the user did not release the "set" button during the first predetermined time period then the red LED blinks twice 556. The system determines whether the user released the "set" button during a second predetermined time period during or after the red LED has blinked twice 558. If the user released the "set" button during the second predetermined time period then the electronic speed control device selects profile 2 560. If the user did not release the "set" button during the second predetermined time period then the red LED blinks thrice 562. The system determines whether the user released the "set" button during a third predetermined time period during or after the red LED has blinked thrice 564. If the user released the "set" button during the third predetermined time period then the electronic speed control device selects profile 3 566. If the user did not release the "set" button during the third predetermined time period then the profile selection mode restarts and the red LED blinks once 550. In one embodiment of the present disclosure the first predetermined time period, the second predetermined time period, and the third predetermined time period are substantially equal. If a profile has been selected an LED may blink green to indicate a successful profile selection. Program selection mode is described in further detail with reference to FIG. 6.

There are many alternative embodiments concerning the profiles, wherein profile 1, profile 2, and profile 3 can comprise many variations. In addition, there can also be different numbers of distinct profiles. In one embodiment, profile 1 may determine that the motor will be supplied with 100% power for maximum forward throttle, 100% for the brakes, and 100% for maximum reverse throttle. Profile 2 may determine that the motor will be supplied with 100% power for maximum forward throttle, 100% for the brakes, and 0% for maximum reverse throttle. For profile 2 the model vehicle will not run in reverse because the electronic speed control device does not apply power to the motor for a user input of reverse throttle. This may be a desired profile when a user is racing the model vehicle and there is no reason for the model vehicle to go in reverse. Profile 3 may determine that the motor will be supplied with 50% power for maximum forward throttle, 100% for the brakes, and 50% for maximum reverse throttle. For profile 3 the electronic speed control device applies no more than 50% power to the motor for maximum forward throttle and no more than 50% power to the motor for maximum reverse throttle. This may be a desired profile for an inexperienced user who may not be able to properly control the vehicle at high speeds. In one embodiment, profile 1 may be the default profile. In further embodiments, profile 3 may determine that that the electronic speed control device applies a percentage of power to the motor less than 100% and greater than 0% for maximum forward throttle and maximum reverse throttle.

This disclosure refers to the percentage power applied to the motor for maximum forward throttle or maximum reverse throttle. In many embodiments, the power applied to the motor in response to forward throttle or reverse throttle for these profiles is proportional to the amount of throttle applied by the user. For example, for profile 1 a user may apply half forward throttle, which indicates that approximately 50% power may be supplied to the motor (for profile 1 100% power is supplied to the motor at maximum forward throttle). If the user applies half forward throttle for profile 3, then approximately 25% power is supplied to the motor (for profile 3 50% power is supplied to the motor at maximum forward throttle).

Figure 6:
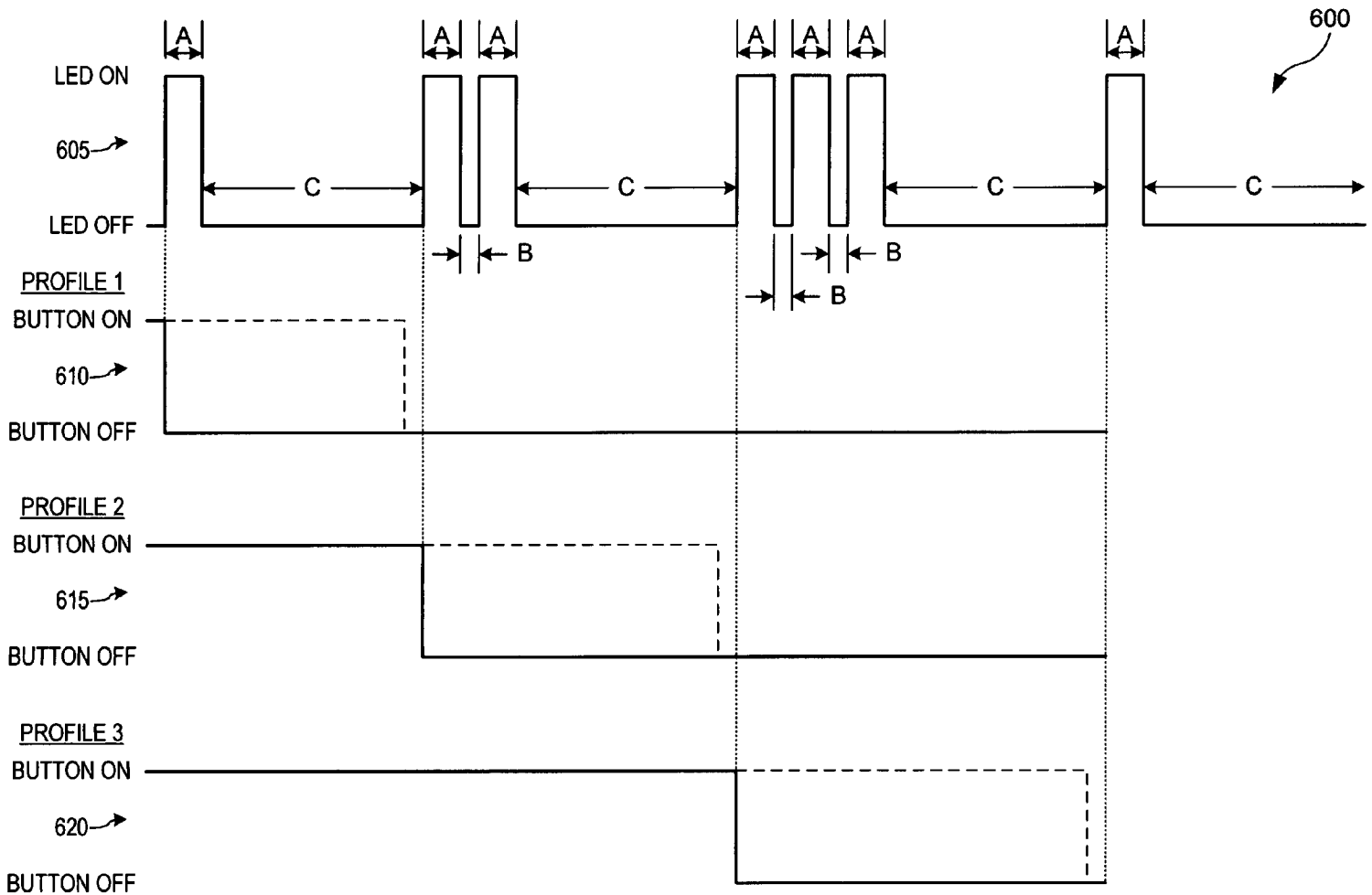
FIG. 6 illustrates four timing diagrams that depict the profile selection mode of one embodiment of the system.

FIG. 6 shows four timing diagrams 600 that illustrate the profile selection mode of one embodiment of the remote controlled model vehicle system. The first timing diagram 605 may illustrate the behavior of the LED during the profile selection mode. Accordingly, the LED may be on or off, wherein the LED is on when a red light may be seen by the user. The time period illustrated by "A" can indicate the time period that the LED is on. The time period illustrated by "B" can indicate the delay between sequential LED light emissions. As shown in diagram 605, the time period "B" is used when there are two or more sequential LED emissions. The time period illustrated by "C" can indicate the delay between profiles. In one embodiment of the present disclosure, time period "A" represents 0.25 seconds, time period "B" represents 0.15 seconds, and time period "C" represents 2.0 seconds. These features of FIG. 6 represent one embodiment of the present disclosure, and therefore the present disclosure is not limited by this specific embodiment.

As previously described, one LED emission can represent profile 1, two sequential LED emissions can represent profile 2, and three sequential LED emissions can represent profile 3. The second timing diagram 610, the third timing diagram 615, and the fourth timing diagram 620 may illustrate the behavior of the user during the profile selection mode. To begin the profile selection mode the user can press and hold a button until he makes his profile selection by releasing the button. Accordingly, the button can be on, which may indicate that the user is holding the button, or the button can be off, which may indicate that the user has released the button.

In the first timing diagram 605, the single LED emission can indicate that the profile selection mode is currently indicating profile 1 to the user. As shown in the second timing diagram 610, the user can select profile 1 by releasing the button within the time period during the single LED emission or a predetermined amount of time after the single LED emission. The predetermined amount of time may be close to the time period "C." If the user does not release the button in the time period indicating profile 1, then two sequential LED emissions can indicate that the profile selection mode is currently indicating profile 2 to the user. As shown in the third timing diagram 615, the user can select profile 2 by releasing the button within the time period during the two LED emissions or the predetermined amount of time after the two LED emissions. If the user does not release the button in the time period indicating profile 1 or profile 2, then three sequential LED emissions can indicate that the profile selection mode is currently indicating profile 3 to the user. As shown in the fourth timing diagram 620, the user can select profile 3 by releasing the button within the time period during the three LED emissions or the predetermined amount of time after the three LED emissions. If the user does not release the button in the time period indicating profile 1, profile 2, or profile 3, then the profile selection mode restarts with a single LED emission that indicates profile 1. Accordingly, the user can select the desired profile by releasing the button at the correct time.

It is understood that multiple embodiments can take many forms and designs. Accordingly, several variations of the present design may be made without departing from the scope of this disclosure. Having thus described specific embodiments, it is noted that the embodiments disclosed are illustrative rather than limiting in nature and that a wide range of variations, modifications, changes, and substitutions are contemplated in the foregoing disclosure and, in some instances, some features may be employed without a corresponding use of the other features. Many such variations and modifications may be considered desirable by those skilled in the art based upon a review of the foregoing description of embodiments. Accordingly, it is appropriate that the appended claims be construed broadly and in a manner consistent with the scope of these embodiments.

The invention claimed is:

1. A method for controlling the speed of a model vehicle comprising:

a user selecting a first profile of a plurality of profiles by holding down a button on a model vehicle for a first time period;

while the first profile is selected:

the user setting a throttle on a transmitter to a maximum forward throttle setting;

in response to the maximum forward throttle setting and the selection of the first profile, an electronic speed control device causing a battery to apply a maximum magnitude of average power to a motor of the model vehicle;

the user setting the throttle to a one-half forward throttle setting;

in response to the one-half forward throttle setting and the selection of the first profile, the electronic speed control device causing the battery to apply one-half of the maximum magnitude of average power to the motor;

the user setting the throttle to a maximum reverse throttle setting;

in response to the maximum reverse throttle setting and the selection of the first profile, the electronic speed control device causing the battery to apply the maximum magnitude of average power to the motor;

the user setting the throttle to a one-half reverse throttle setting;

in response to the one-half reverse throttle setting and the selection of the first profile, the electronic speed control device causing the battery to apply one-half of the maximum magnitude of average power to the motor;

the user selecting a second profile of the plurality of profiles by holding down the button on the model vehicle for a second time period;

while the second profile is selected:

the user setting the throttle to the maximum forward throttle setting;

in response to the maximum forward throttle setting and the selection of the second profile, the electronic speed control device causing the battery to apply one-half of the maximum magnitude of average power to the motor;

the user setting the throttle to the one-half forward throttle setting;

in response to the one-half forward throttle setting and the selection of the second profile, the electronic speed control device causing the battery to apply one-fourth of the maximum magnitude of average power to the motor;

the user setting the throttle to the maximum reverse throttle setting;

in response to the maximum reverse throttle setting and the selection of the second profile, the electronic speed control device causing the battery to apply one-half of the maximum magnitude of average power to the motor;

the user setting the throttle to the one-half reverse throttle setting;

in response to the one-half reverse throttle setting and the selection of the second profile, the electronic speed control device causing the battery to apply one-fourth of the maximum magnitude of average power to the motor.

2. The method of claim 1, further comprising a light-emitting diode blinking a number of times identifying the first profile.

3. The method of claim 1, further comprising a light-emitting diode blinking a number of times identifying the second profile.

4. A method for controlling the speed of a model vehicle comprising:

receiving a selection of a first profile of a plurality of profiles, the selection comprising a holding down of a button on a model vehicle for a first time period;

while the first profile is selected:

a throttle on a transmitter receiving a maximum forward throttle setting;

in response to the maximum forward throttle setting and the selection of the first profile, an electronic speed control device causing a battery to apply a maximum magnitude of average power to a motor of the model vehicle;

the throttle receiving a one-half forward throttle setting;

in response to the one-half forward throttle setting and the selection of the first profile, the electronic speed control device causing the battery to apply one-half of the maximum magnitude of average power to the motor;

the throttle receiving a maximum reverse throttle setting;

in response to the maximum reverse throttle setting and the selection of the first profile, the electronic speed control device causing the battery to apply the maximum magnitude of average power to the motor;

the throttle receiving a one-half reverse throttle setting;

in response to the one-half reverse throttle setting and the selection of the first profile, the electronic speed control device causing the battery to apply one-half of the maximum magnitude of average power to the motor;

receiving a selection of a second profile of the plurality of profiles, the selection comprising a holding down of the button on the model vehicle for a second time period;

while the second profile is selected:

the throttle receiving the maximum forward throttle setting;

in response to the maximum forward throttle setting and the selection of the second profile, the electronic speed control device causing the battery to apply one-half of the maximum magnitude of average power to the motor;

the throttle receiving the one-half forward throttle setting;

in response to the one-half forward throttle setting and the selection of the second profile, the electronic speed control device causing the battery to apply one-fourth of the maximum magnitude of average power to the motor;

the throttle receiving the maximum reverse throttle setting;

in response to the maximum reverse throttle setting and the selection of the second profile, the electronic speed control device causing the battery to apply one-half of the maximum magnitude of average power to the motor;

the throttle receiving the one-half reverse throttle setting;

in response to the one-half reverse throttle setting and the selection of the second profile, the electronic speed control device causing the battery to apply one-fourth of the maximum magnitude of average power to the motor.

5. The method of claim 4, further comprising a light-emitting diode blinking a number of times identifying the first profile.

6. The method of claim 4, further comprising a light-emitting diode blinking a number of times identifying the second profile.

7. A remote controlled model vehicle system, comprising:

a throttle on a transmitter, the throttle configured to receive at least a maximum forward throttle setting, a one-half forward throttle setting, a maximum reverse throttle setting, and a one-half reverse throttle setting; and an electronic speed control device configured to:

receive a selection of a first profile of a plurality of profiles, the selection comprising a holding down of a button on a model vehicle for a first time period;

receive a selection of a second profile of the plurality of profiles, the selection comprising a holding down of the button for a second time period;

in response to the maximum forward throttle setting and the selection of the first profile, cause a battery to apply a maximum magnitude of average power to a motor of the model vehicle;

in response to the one-half forward throttle setting and the selection of the first profile, cause the battery to apply one-half of the maximum magnitude of average power to the motor;

in response to the maximum reverse throttle setting and the selection of the first profile, cause the battery to apply the maximum magnitude of average power to the motor;

in response to the one-half reverse throttle setting and the selection of the first profile, cause the battery to apply one-half of the maximum magnitude of average power to the motor;

in response to the maximum forward throttle setting and the selection of the second profile, cause the battery to apply one-half of the maximum magnitude of average power to the motor;

in response to the one-half forward throttle setting and the selection of the second profile, cause the battery to apply one-fourth of the maximum magnitude of average power to the motor;

in response to the maximum reverse throttle setting and the selection of the second profile, cause the battery to apply one-half of the maximum magnitude of average power to the motor; and in response to the one-half reverse throttle setting and the selection of the second profile, cause the battery to apply one-fourth of the maximum magnitude of average power to the motor.

8. The remote controlled model vehicle system of claim 7, further comprising a light-emitting diode configured to blink a number of times identifying the first profile.

9. The remote controlled model vehicle system of claim 7, further comprising a light-emitting diode configured to blink a number of times identifying the second profile.

* * * * *